US009623282B2

(12) United States Patent
Tung et al.

(10) Patent No.: US 9,623,282 B2
(45) Date of Patent: Apr. 18, 2017

(54) FIGURE TRIMMER

(71) Applicant: Dyaco(Shanghai)Trading Co., Ltd., Shanghai (CN)

(72) Inventors: Hung Ta Tung, Taipei (TW); Hsuan-Fu Huang, Taipei (TW)

(73) Assignee: Dyaco International Inc., Taipei (TW)

( * ) Notice: Subject to any disclaimer, the term of this patent is extended or adjusted under 35 U.S.C. 154(b) by 145 days.

(21) Appl. No.: 14/565,299

(22) Filed: Dec. 9, 2014

(65) Prior Publication Data

US 2016/0059070 A1 Mar. 3, 2016

(30) Foreign Application Priority Data

Aug. 27, 2014 (TW) ..... 103129577 A

(51) Int. Cl.
*A63B 21/008* (2006.01)
*A63B 23/08* (2006.01)
(Continued)

(52) U.S. Cl.
CPC ..... *A63B 22/14* (2013.01); *A63B 21/028* (2013.01); *A63B 21/0552* (2013.01);
(Continued)

(58) Field of Classification Search
CPC ..... A63B 21/00043; A63B 21/008; A63B 21/0083; A63B 21/0085; A63B 21/0087; A63B 21/012; A63B 21/015; A63B 21/02; A63B 21/022; A63B 21/026; A63B 21/028; A63B 21/04; A63B 21/0407; A63B 21/0435; A63B 21/045; A63B 21/0455; A63B 21/05; A63B 21/055; A63B 21/0552; A63B 21/4034; A63B 21/4049;
(Continued)

(56) References Cited

U.S. PATENT DOCUMENTS 4,200,282 A * 4/1980 Agyagos ..... A63B 17/00 482/147
4,376,532 A * 3/1983 Hunstad ..... A63B 69/18 482/146
(Continued)

FOREIGN PATENT DOCUMENTS

CN 2598589 Y 1/2004
CN 202289322 U 7/2012
(Continued)

OTHER PUBLICATIONS

Extended European Search Report dated Jan. 7, 2016 in related European Application 14187898.3.
(Continued)

*Primary Examiner* — Joshua Lee
(74) *Attorney, Agent, or Firm* — Donald E. Stout; Stout, Uxa & Buyan, LLP

(57) ABSTRACT

A figure trimmer comprises a base, a pedal set, and a rotating assembly. The pedal set comprises a left pedal and a right pedal. The rotating assembly movably connects with the base. The rotating assembly is able to rotate about a shaft of the base. The rotating assembly comprises two ends, in which one end includes a first shaft and the other includes a second shaft. The left pedal can rotate about the first shaft, and the right pedal can rotate about the second shaft.

4 Claims, 9 Drawing Sheets

(51) Int. Cl.

| | |
|---|---|
| ***A63B 23/10*** | (2006.01) |
| ***A63B 21/015*** | (2006.01) |
| ***A63B 21/02*** | (2006.01) |
| ***A63B 21/045*** | (2006.01) |
| ***A63B 21/04*** | (2006.01) |
| ***A63B 22/14*** | (2006.01) |
| ***A63B 22/00*** | (2006.01) |
| ***A63B 22/16*** | (2006.01) |
| ***A63B 23/035*** | (2006.01) |
| ***A63B 21/00*** | (2006.01) |
| ***A63B 21/055*** | (2006.01) |
| ***A63B 23/02*** | (2006.01) |
| *A63B 21/05* | (2006.01) |

(52) U.S. Cl.

CPC ..... *A63B 21/4034* (2015.10); *A63B 21/4047* (2015.10); *A63B 21/4049* (2015.10); *A63B 22/0058* (2013.01); *A63B 22/16* (2013.01); *A63B 23/0222* (2013.01); *A63B 23/03525* (2013.01); *A63B 23/03541* (2013.01); *A63B 21/008* (2013.01); *A63B 21/0085* (2013.01); *A63B 21/023* (2013.01); *A63B 21/05* (2013.01); *A63B 2022/003* (2013.01); *A63B 2210/50* (2013.01)

(58) Field of Classification Search

CPC ..... A63B 22/0048; A63B 22/0061; A63B 22/0064; A63B 22/066; A63B 22/0069; A63B 22/14; A63B 22/18; A63B 2022/003; A63B 2022/0074; A63B 2023/003; A63B 23/0216; A63B 2208/0204

See application file for complete search history.

(56) References Cited

U.S. PATENT DOCUMENTS

| | | | | | |
|---|---|---|---|---|---|
| 5,632,711 | A * | 5/1997 | Hwang | A63B 22/14 | 482/146 |
| 5,807,210 | A * | 9/1998 | Devlin | A63B 22/0056 | 482/146 |
| 6,306,068 | B1 * | 10/2001 | Heatwole | A63B 21/0004 | 482/146 |
| 6,709,367 | B1 * | 3/2004 | Liang | A63B 22/0058 | 482/146 |
| 6,921,353 | B2 * | 7/2005 | Chuang | A63B 22/0058 | 482/146 |
| 7,104,928 | B1 * | 9/2006 | Liu | A63B 22/0064 | 482/52 |
| 7,115,073 | B2 * | 10/2006 | Nizamuddin | A63B 21/157 | 434/253 |
| 7,137,928 | B1 | 11/2006 | Chen | | |
| 7,621,861 | B1 * | 11/2009 | Kalember | A63B 22/14 | 482/146 |
| 7,645,221 | B1 * | 1/2010 | Curry | A63B 21/023 | 482/142 |
| 7,727,121 | B1 * | 6/2010 | Wang | A63B 21/023 | 482/52 |
| 7,862,491 | B1 * | 1/2011 | Wang | A63B 21/055 | 482/130 |
| 7,878,960 | B1 * | 2/2011 | Liu | A63B 22/0058 | 482/146 |
| 7,981,005 | B1 * | 7/2011 | Tsai | A63B 21/055 | 482/147 |
| 9,039,583 | B2 * | 5/2015 | Huang | A63B 23/10 | 482/123 |
| 2002/0137610 | A1 * | 9/2002 | Broudy | A63B 22/14 | 482/147 |
| 2003/0092546 | A1 * | 5/2003 | Yu | A61H 1/0255 | 482/142 |
| 2003/0144118 | A1 * | 7/2003 | Tsen | A63B 21/023 | 482/130 |
| 2004/0097336 | A1 * | 5/2004 | Chuang | A63B 22/001 | 482/52 |
| 2004/0097337 | A1 * | 5/2004 | Chuang | A63B 22/001 | 482/52 |
| 2005/0043143 | A1 * | 2/2005 | Chuang | A63B 22/14 | 482/51 |
| 2005/0049116 | A1 * | 3/2005 | Huang | A63B 22/0064 | 482/51 |
| 2005/0164849 | A1 * | 7/2005 | Saikawa | A63B 22/14 | 482/92 |
| 2006/0229166 | A1 * | 10/2006 | Fan | A63B 22/001 | 482/53 |
| 2006/0240950 | A1 * | 10/2006 | Chang | A63B 22/0064 | 482/52 |
| 2007/0179027 | A1 * | 8/2007 | Van Straaten | A63B 22/14 | 482/71 |
| 2007/0270284 | A1 * | 11/2007 | Lin | A63B 22/0069 | 482/52 |
| 2008/0280741 | A1 * | 11/2008 | Baek | A63B 22/14 | 482/146 |
| 2009/0156378 | A1 * | 6/2009 | Wang | A63B 21/0552 | 482/138 |
| 2009/0163337 | A1 * | 6/2009 | Petrakov | A61H 1/005 | 482/147 |
| 2009/0239713 | A1 | 9/2009 | Chu | | |
| 2010/0152006 | A1 * | 6/2010 | Wang | A63B 22/14 | 482/147 |
| 2010/0179036 | A1 * | 7/2010 | Wang | A63B 21/4047 | 482/112 |
| 2010/0248923 | A1 * | 9/2010 | Lo | A63B 5/00 | 482/146 |
| 2011/0045955 | A1 * | 2/2011 | Savane | A63B 22/0056 | 482/52 |
| 2011/0071005 | A1 * | 3/2011 | Lai | A63B 21/154 | 482/52 |
| 2011/0071006 | A1 * | 3/2011 | Lai | A63B 21/0087 | 482/53 |
| 2011/0281701 | A1 * | 11/2011 | Zhang | A63B 22/14 | 482/146 |
| 2011/0287914 | A1 * | 11/2011 | Morris | A63B 21/00069 | 482/147 |
| 2012/0108406 | A1 | 5/2012 | Jeong | | |

FOREIGN PATENT DOCUMENTS

| | | |
|---|---|---|
| CN | 203736786 U | 7/2014 |
| DE | 202014102450 U1 | 7/2014 |

OTHER PUBLICATIONS

PCT International Search Report dated Mar. 21, 2014 in related PCT Application No. PCT/CN2014/000310.

* cited by examiner

FIGURE TRIMMER

CROSS-REFERENCE TO RELATED APPLICATIONS

The entire contents of Taiwan Patent Application No. 103129577, filed on Aug. 27, 2014, from which this application claims priority, are incorporated herein by reference.

BACKGROUND OF THE INVENTION

1. Field of the Invention

The present invention relates to a training machine, and more particularly relates to a figure trimmer.

2. Description of Related Art

Conventional figure trimmers include a disc on which a user stands to twist his or her body by the force of legs and waist.

FIG. 1 shows a conventional figure trimmer provided by a Taiwan patent M33009977. As shown in FIG. 1, the figure trimmer includes a base 10 and two discs 12/14.

The conventional figure trimmer has a disadvantage that only a few muscles of the user are used and hence a need is therefore arisen to improve it.

SUMMARY OF THE INVENTION

In one general aspect, the present invention relates to figure trimmers with improved training efficiency.

In an embodiment of the present invention, a figure trimmer is provided with a chassis, a pedal set, and a rotating assembly. The chassis comprises an axle. The pedal set is arranged on the chassis and has a left pedal and a right pedal for being stepped by a user. The rotating assembly movably connects with the chassis and the pedal set, wherein the rotating assembly comprises a cylinder arranged on the axle of the chassis and two supporting frames respectively arranged at a side of the cylinder with an end far from the cylinder having a first shaft and a second shaft, and wherein the first shaft movably couples with the left pedal, and the second shaft movably couples with the right pedal. Whereby the left pedal and the pedal rotate around the axle, the left pedal rotates around the first shaft, and/or the right pedal rotates around the second shaft.

In an embodiment, the pedal set further comprises a left pad on the left pedal and a right pad on the right pedal.

In an embodiment, an angle between a vertical direction and the left pad or the right pad is less than 90°.

In an embodiment, the figure trimmer further comprises at least a first elastic component arranged between the chassis and the rotating assembly, and when the rotating assembly bears the pedal set rotating around the axle and compresses the first elastic component, the first elastic component exerts a counterforce to the pedal set via the rotating assembly.

In an embodiment, the figure trimmer further comprises a plurality of second elastic component arranged below the left pedal and the right pedal, and when the left pedal or the right pedal rotates around the first shaft or the second shaft causing that a contact between the corresponded supporting frame and one or more of the plurality of second elastic components, the one or more of the plurality of second elastic components will exert a counterforce to the corresponded supporting frame.

In an embodiment, the first elastic component and the second elastic component are made of a polymer.

In an embodiment, the first elastic component and the second elastic component are two spring members.

In an embodiment, the first elastic component and the second elastic component are two hydraulic elastic members.

In an embodiment, the first elastic component and the second elastic component are two pneumatic elastic members.

In an embodiment, the figure trimmer further comprises a pillar structure with a lower end couples with the chassis and a handrail for being held by the user.

In an embodiment, the figure trimmer further comprises a pillar structure, a left arm lever, and a right arm lever, wherein the left arm lever and the right arm lever respectively has an end with a holding portion for being held by the user and another end coupling with an end of a swing arm and pivotally coupling with the pillar structure via a pivot portion, and the swing arm has another end coupling with an end of a linkage arm, and the linkage arm has another end pivotally coupling with the first shaft or the second shaft.

In an embodiment, the figure trimmer further comprises a pillar structure, a left arm lever, and a right arm lever, wherein the left arm lever and the right arm lever respectively has a first end with a holding portion for being held by the user and a second end with a first gear engaging with a second gear of a first end of a swing arm which pivotally couples with the pillar structure via a pivot portion, and the swing arm has a second end coupling with a first end of a linkage arm, and the linkage arm has a second end pivotally coupling with the first shaft or the second shaft.

DETAILED DESCRIPTION OF THE PREFERRED EMBODIMENT

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1:
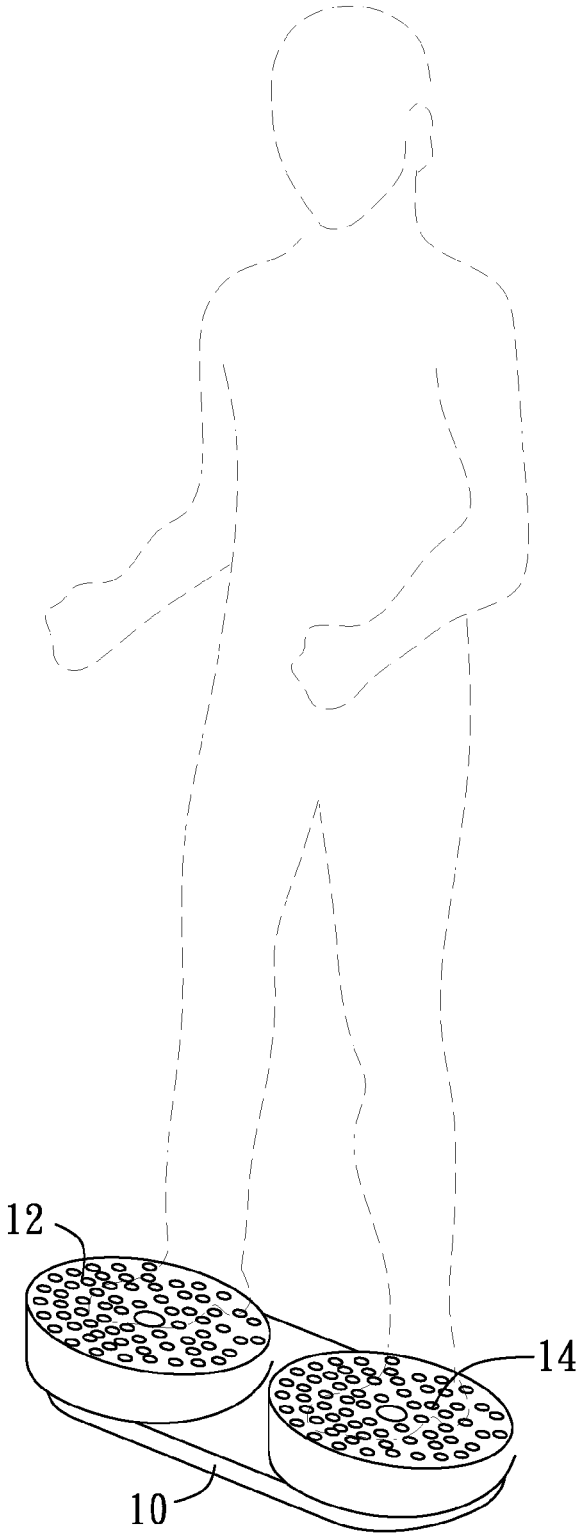
FIG.1(Prior Art)
FIG. 1 shows a conventional figure trimmer provided by a Taiwan patent M33009977.
Figure 2:
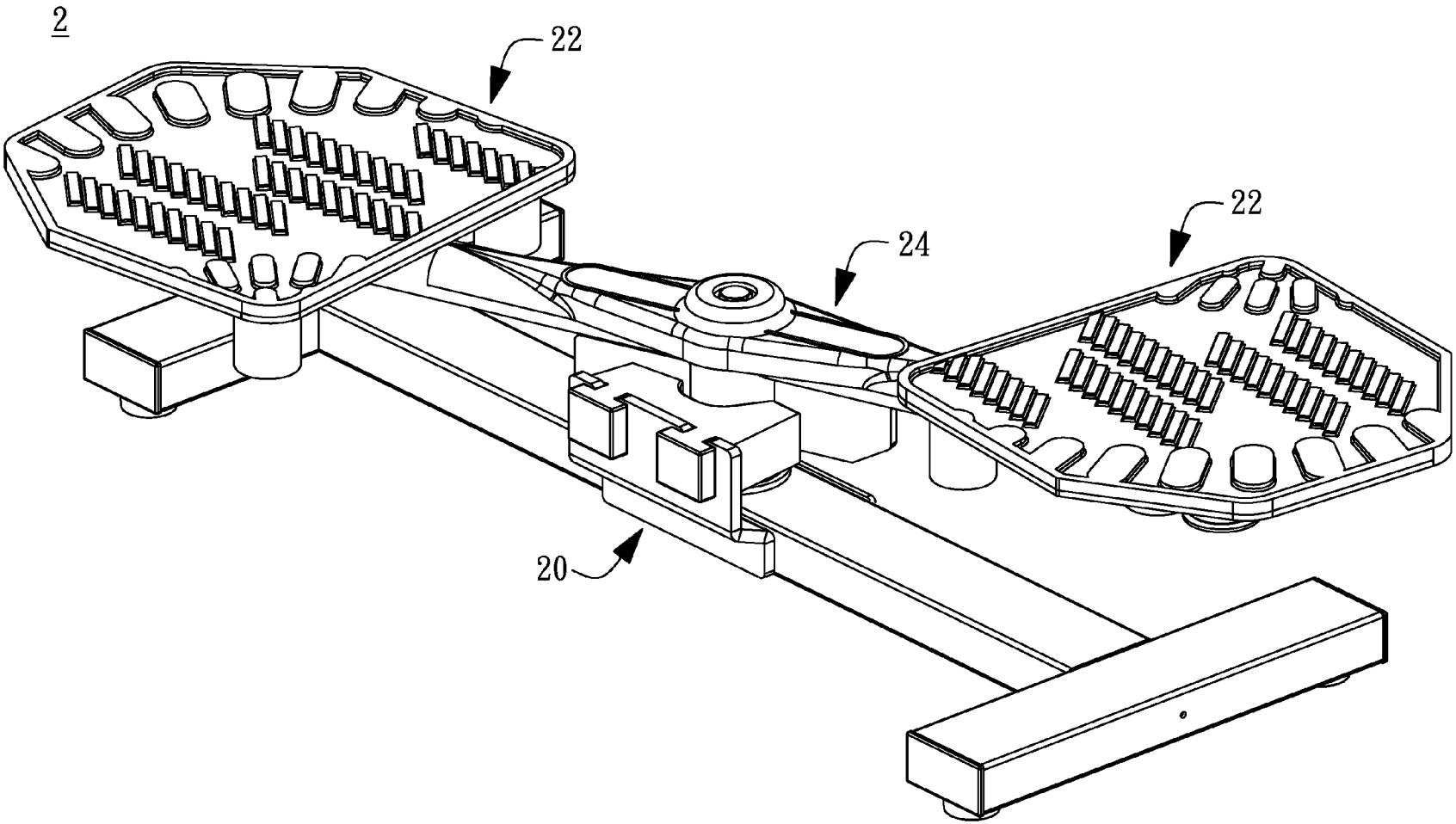
FIGS. 2 and 3 are respectively perspective and exploded view, showing a figure trimmer according to a preferred embodiment of the present invention.
Figure 3:
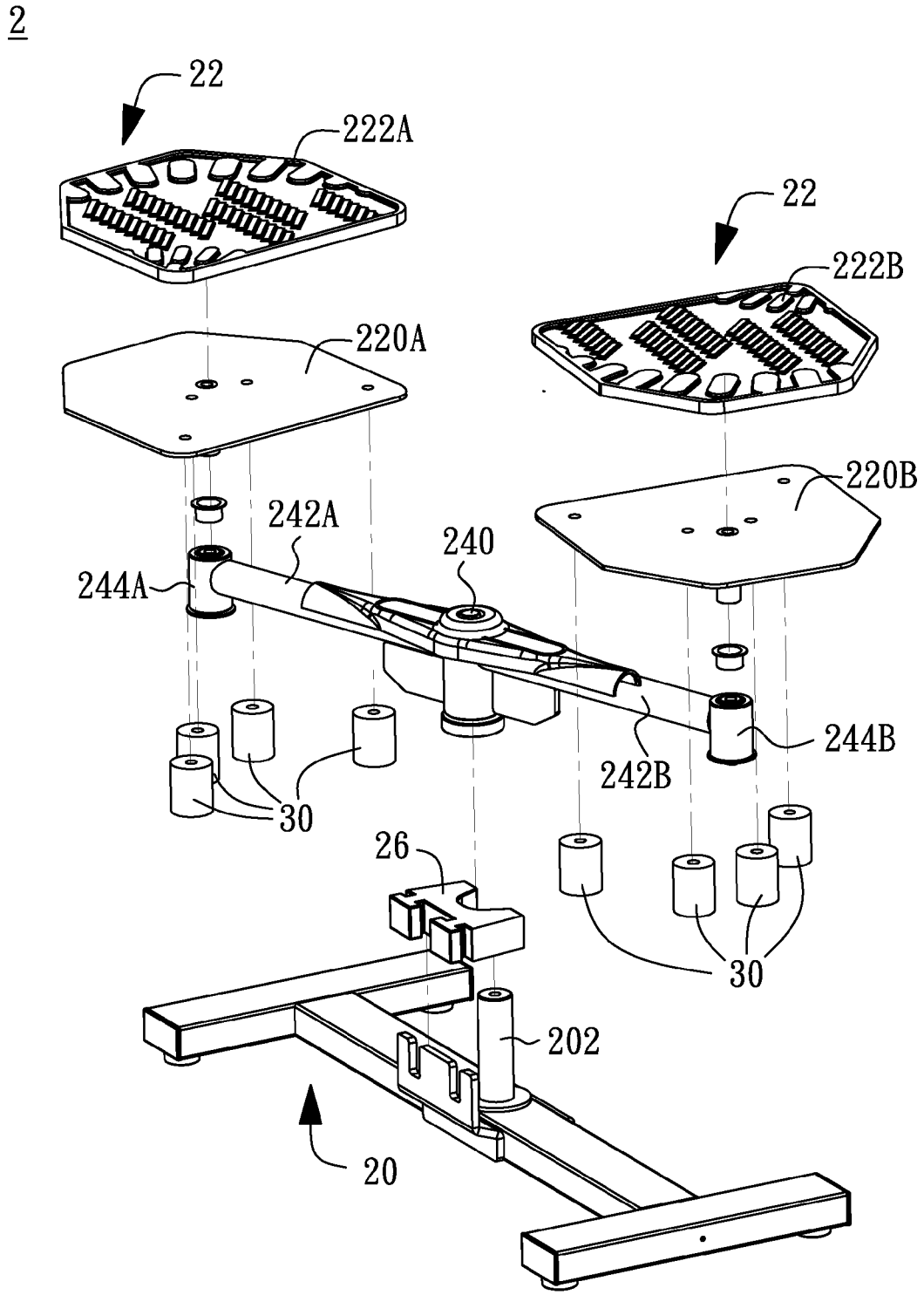

FIGS. 2 and 3 are respectively perspective and exploded view, showing a figure trimmer 2 according to a preferred embodiment of the present invention. As shown in FIG. 2 and FIG. 3, the figure trimmer 2 comprises a chassis 20, a pedal set 22, and a rotating assembly 24. The pedal set 22 comprises a left pedal 220A and a right pedal 220B. In addition, a left pad 222A may be arranged on the left pedal 220A, and a right pad 222B may be arranged on the right pedal 220B. In another embodiment of the present invention, the left pad 222A and the right pad 222B are omitted.

As shown in FIGS. 2 and 3, the rotating assembly 24 movably couples with the chassis 20 and the pedal set 22. For example, the chassis 20 preferably comprises an axle 202 and the rotating assembly preferably comprises a cylinder 240 and two supporting frames 242 A/B. The cylinder 240 is mounted on an axle 202 of the chassis 20, the two supporting frames 242 are respectively arranged at a side of the cylinder 240, and the two supporting frames 242A/B respectively movably couples to the left pedal 220A and the right pedal 220B. In detail, the supporting frame 242A has an end far from the cylinder 240 and the end has a first shaft 244A movably coupled with the left pedal 220A, and the supporting frame 242B has an end far from the cylinder 240 and the end has a second shaft 244B movably coupled with the right pedal 220B.

The user's left foot and right foot respectively step on the left pedal 220A and the right pedal 220B (or the left pad 222A and the right pad 222B). By exerting a force the legs and waist, the left pedal 220A and the right pedal 220B can rotate around the axle 202. And by exerting a force by ankle, the left pedal 220A can rotate around the first shaft 244A, and/or the right pedal 220B can rotate around the second shaft 244B.

As shown in FIGS. 2 and 3, the figure trimmer 2 preferably comprises at least a first elastic component 26 arranged between the chassis 20 and the rotating assembly 24. When the rotating assembly 24 bears the pedal set 22 rotating around the axle 202 and compressing the first elastic component 26, the first elastic component 26 will exert a counterforce to the pedal set 22 via the rotating assembly 24.

Figure 4:
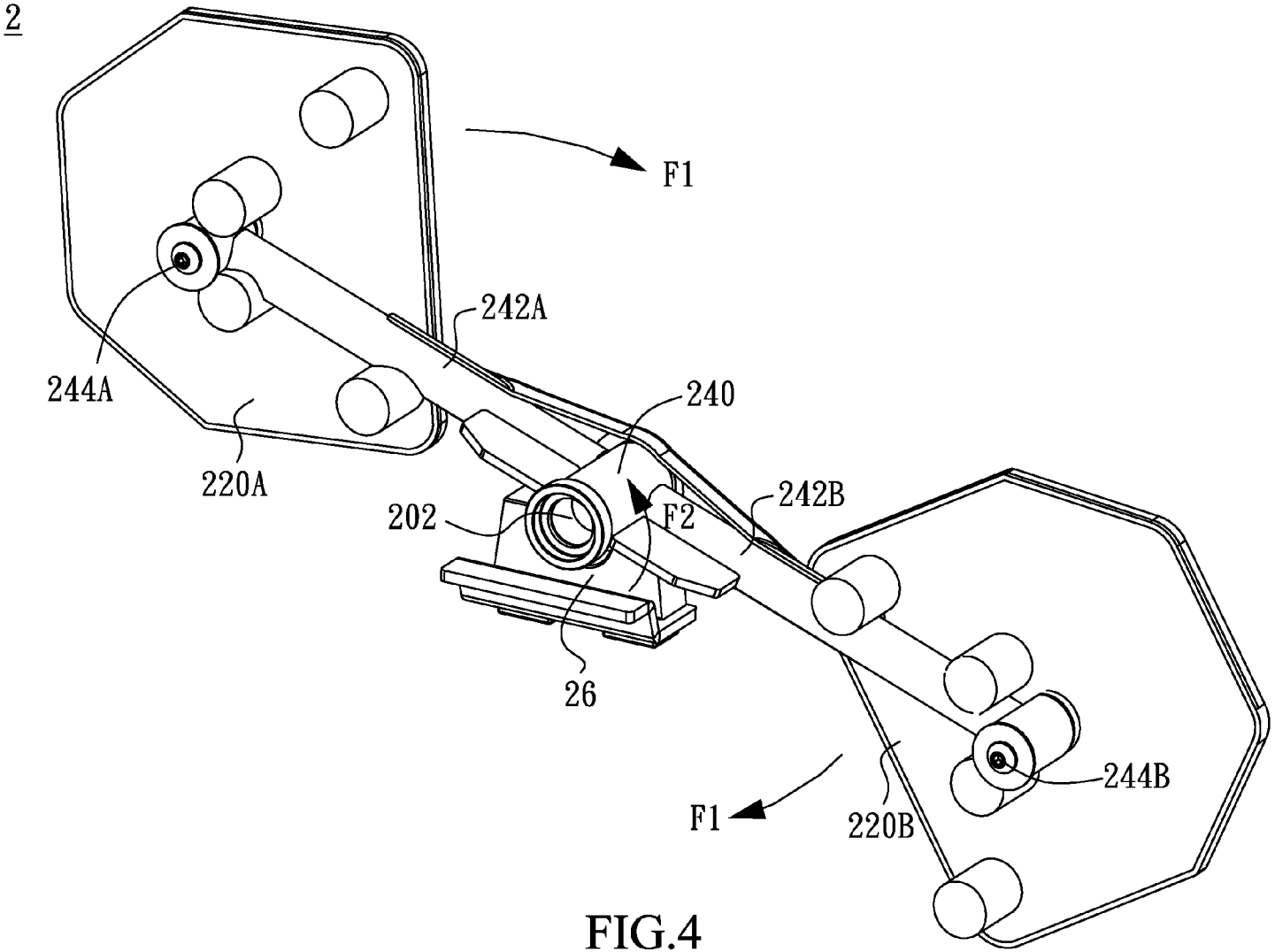
FIGS. 4 and 5 are bottom simplified view of the figure trimmer according to the preferred embodiment of the present invention.

FIG. 4 is a bottom simplified view showing the figure trimmer 2 in accordance with the preferred embodiment of the present invention, where the chassis 20 (FIG. 3) is omitted for clarity. As shown in FIGS. 3 and 4, when the user exerts a force F1 resulting in the left pedal 220A and the right pedal 220B rotating around the axle 202 and compressing the first elastic component 26, the first elastic component 26 will exert a counterforce F2 to the pedal set 22 via the rotating assembly 24.

Figure 5:
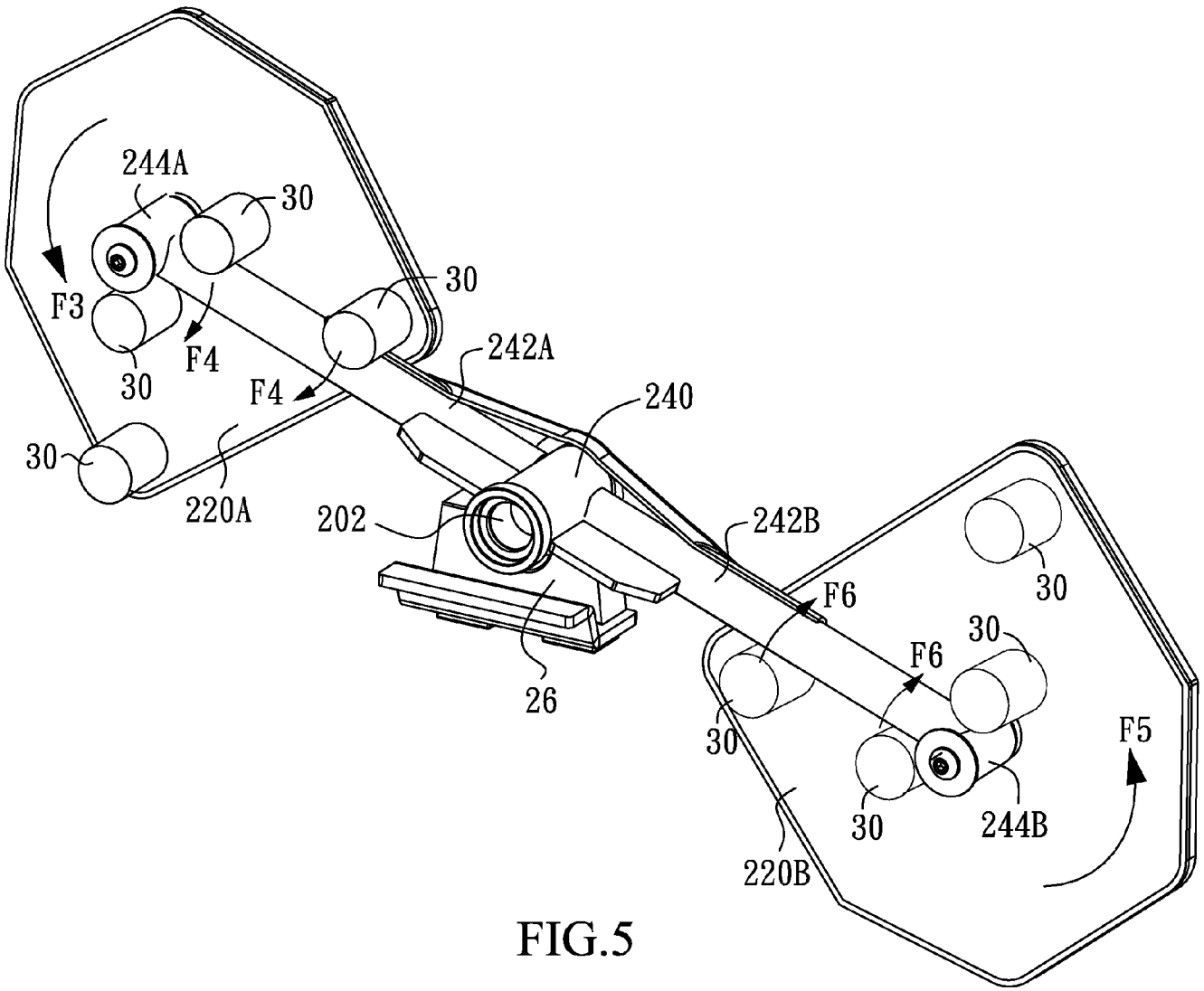

FIG. 5 is a bottom simplified view showing the figure trimmer 2 in accordance with the preferred embodiment of the present invention, where the chassis 20 (FIG. 3) is omitted for clarity. As previously mentioned, the left pedal 220A and the right pedal 220B can rotate around the axle 202, and they can also rotate around the first shaft 244A and the second shaft 244B, respectively. In addition, a plurality of second elastic components 30 are arranged blow each of the pedals, i.e., the left pedal 220A and the right pedal 220B. When the left pedal 220A and/or the right pedal 220B rotates around the first shaft 244A and/or the second shaft 244B so that the supporting frame 242A and/or the supporting frame 242B touches one or more of the second elastic components 30, the touched one or more second elastic components 30 will exert a counterforce to the supporting frame 242A and/or the supporting frame 242B. As illustrated in FIG. 5, when the user exerts a force F3 to cause the left pedal 220A rotating around the first shaft 244A and the supporting frame 242A touching one or more the second elastic components 30, the one or more second elastic components 30 will exert a counterforce F4 to the supporting frame 242A. As illustrated in FIG. 5, when the user exerts a force F5 to cause the right pedal 220B rotating around the second shaft 244B and the supporting frame 242B touching one or more the second elastic components 30, the one or more second elastic components 30 will exert a counterforce F6 to the supporting frame 242B.

In this preferred embodiment, the first elastic component 26 is arranged between the rotating assembly 24 and the chassis 20. The first elastic component 26 couples with the chassis 26 by a proper manner, e.g., by fitting. The second elastic component 30 may have a composite configuration. For example, each of the second elastic components 30 may comprise a rigid rod (e.g., a metal rod) and an elastic material around the rigid rod.

In this preferred embodiment, the number of the first elastic component 26 is single; however, it could be plural, e.g., two, in another embodiment of the present invention. For example, two first elastic components 26 are symmetrically arranged around the axle 202.

In one embodiment, the first elastic component 26 and the second elastic components 30 are made of a polymer.

In one embodiment, the first elastic component 26 and/or the second elastic components 30 are spring members.

In one embodiment, the first elastic component 26 and/or the second elastic components 30 are hydraulic elastic members.

In one embodiment, the first elastic component 26 and/or the second elastic components 30 are pneumatic elastic members.

Figure 6:
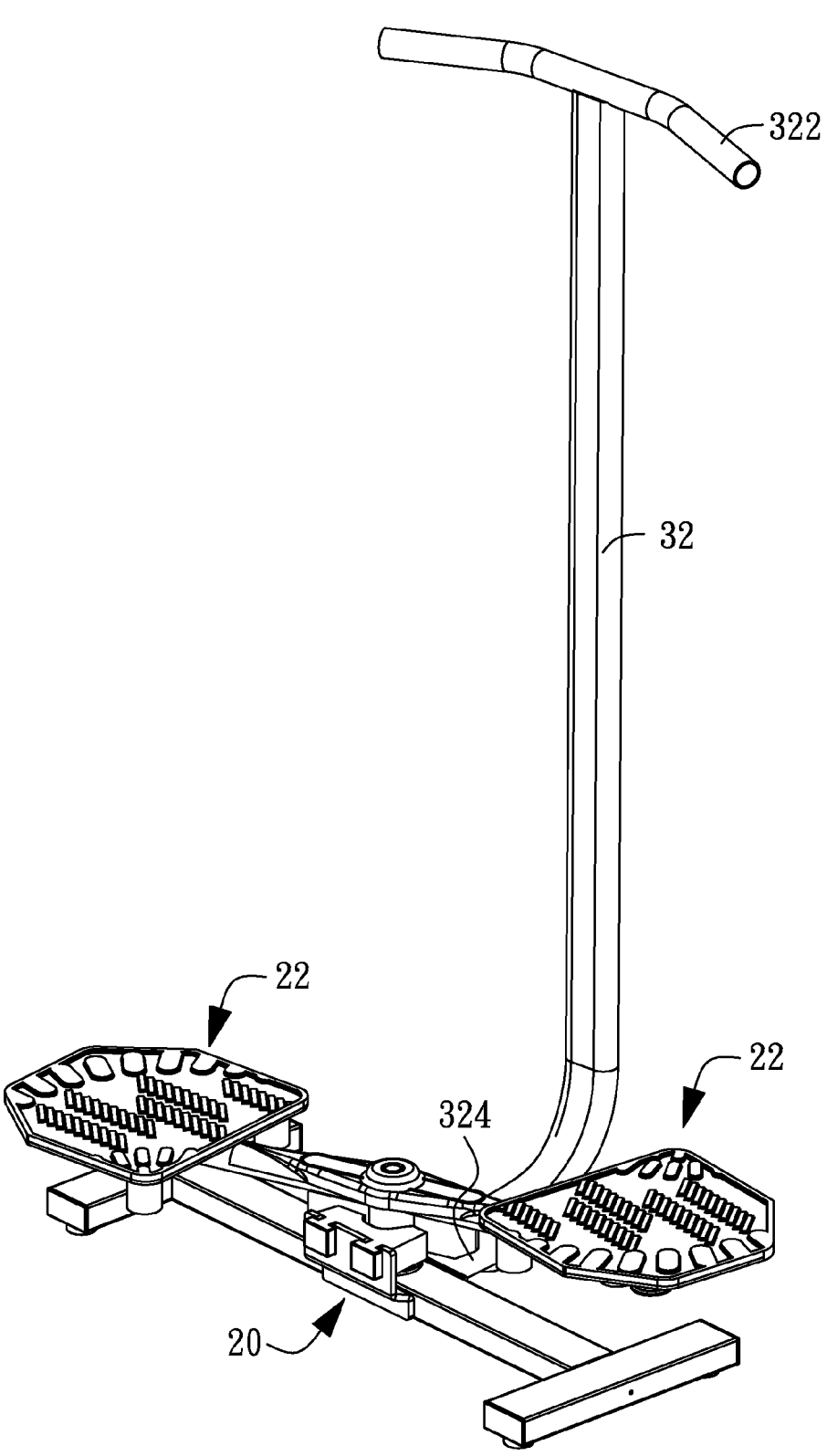
FIG. 6 is a perspective view showing a figure trimmer according to another embodiment of the present invention.

FIG. 6 is a front view showing a figure trimmer 3 in accordance with another embodiment of the present invention. The figure trimmer 3 has similar features as the above mentioned figure trimmer 2. In addition, the figure trimmer 3 has a pillar structure 32. The upper end of the pillar structure 32 has a handrail 322 for being held by the user and the lower end of the pillar structure 32 couples with the chassis 20. This configuration promotes the safety of operation.

Figure 7:
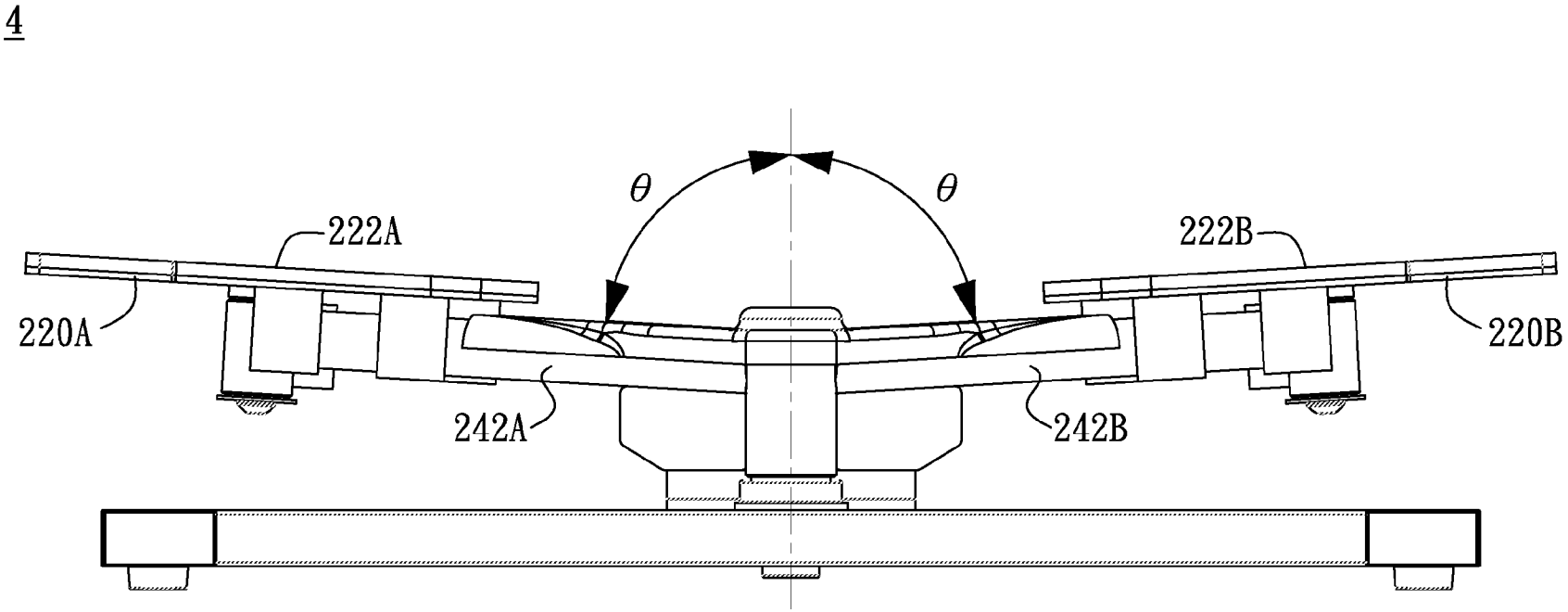
FIG. 7 is a side view showing a figure trimmer according to another embodiment of the present invention.

FIG. 7 is a side view sowing a figure trimmer 4 according to another embodiment of the present invention. The figure trimmer 4 has similar features as the above mentioned figure trimmer 2. In addition, the difference is that the left pedal 220A and the right pedal 220B, or the pad 222A and the pad 222B, are not horizontally arranged. Instead, an angle θ typically a bit less than 90°, such as 87°, is present between the vertical direction and the left pedal 220A and the right pedal 220B, or between the vertical direction and the pad 222A and the pad 222B. The incline angle can be achieved by adjusting the supporting frame 242A/B or by providing the pad 222A/B with an incline surface.

Figure 8:
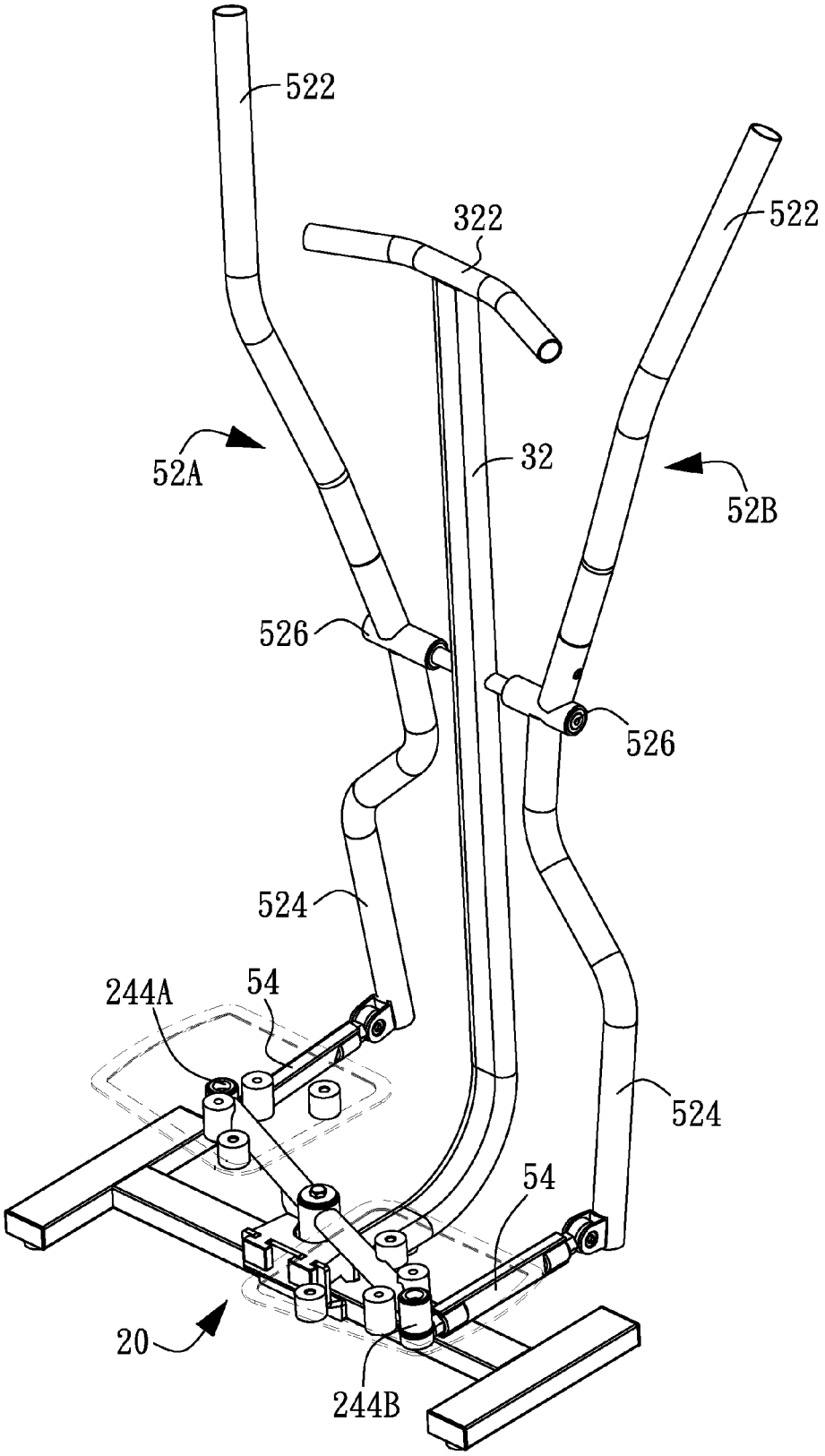
FIG. 8 is a perspective view showing a figure trimmer according to another embodiment of the present invention.

FIG. 8 is a front view sowing a figure trimmer 5 according to another embodiment of the present invention. The figure trimmer 5 has similar features as the figure trimmers 2, 3, and/or 4. In addition, the figure trimmer 5 has a left arm lever 52A and a right arm lever 52B. The left arm lever 52A and the right lever 52B have an upper end with a holding portion 522 for being held by the user, and have a lower end couples with an end of a swing arm 524. In addition, the left arm lever 52A and the right lever 52B pivotally couples with the pillar structure 32 via a pivot portion 526. Each swing arm 524 has two ends, in which one end couples with the pivot portion 526 and the other end couples with a linkage arm 54. Each linkage arm 54 has two ends, in which one end pivotally couples with the swing arm, and the other end pivotally couples with the first shaft 244A or the second shaft 244B. Accordingly, the left arm lever 52A and the right aim lever 52B can swing forward and backward in relative to the pillar structure 32.

Figure 9:
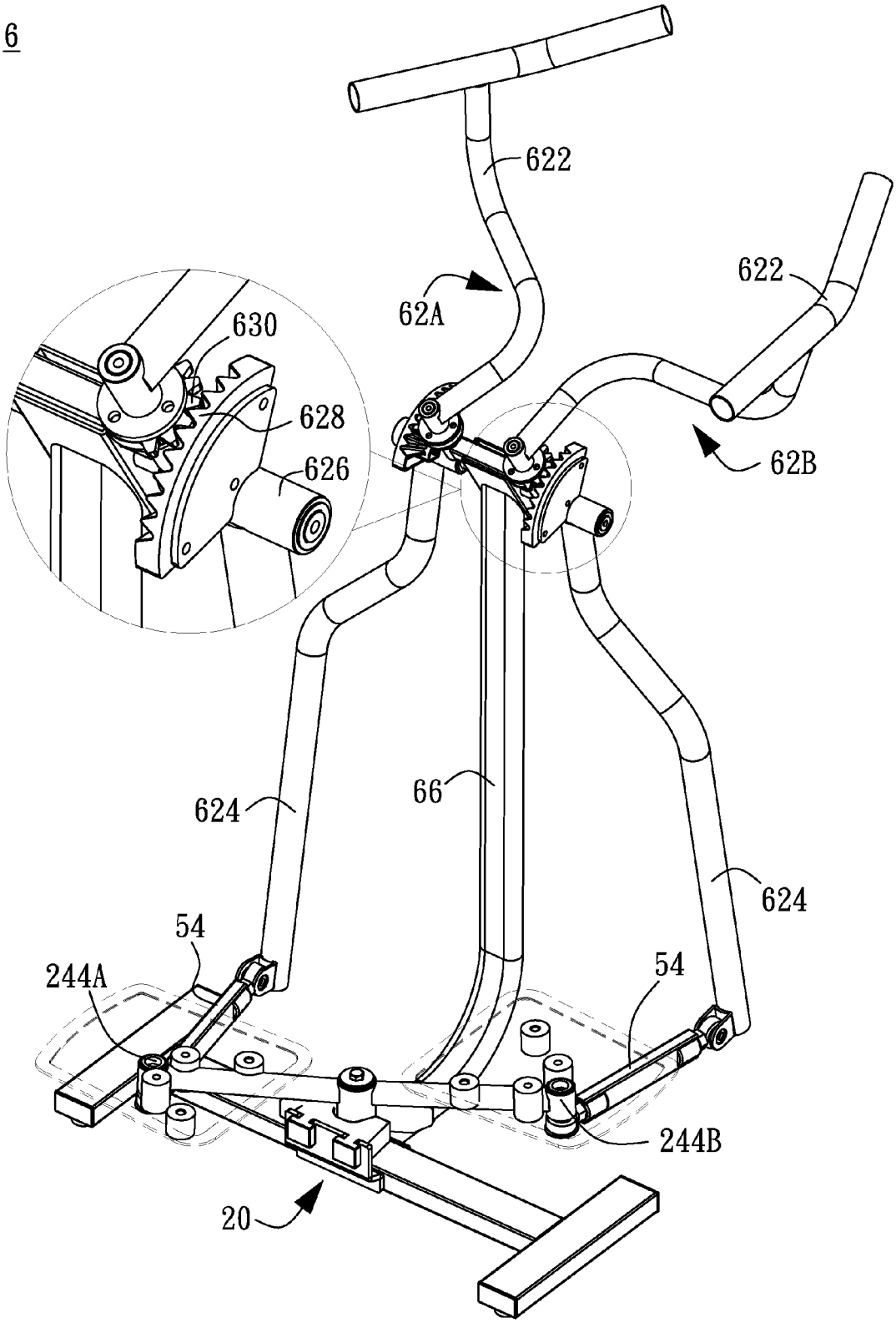
FIG. 9 is a perspective view showing a figure trimmer according to another embodiment of the present invention.

FIG. 9 is a front view sowing a figure trimmer 6 according to another embodiment of the present invention. The figure trimmer 6 has similar features as the figure trimmers 2, 3, and/or 4. In addition, the figure trimmer 6 has a left arm lever 62A and a right arm lever 32B. Each arm lever 62A/B has two ends, in which one end has a holding portion 622 for being held by the user and the other end has a gear 630 engaging with a gear 628 of a swing arm 624. Each swing arm 624 has an upper end with a pivot portion 626 pivotally coupling with the pillar structure 66. In addition, each swing arm 624 has a lower end pivotally couples with an end of a linkage arm 54, which has another end pivotally couples with the first shaft 244A or the second shaft 244B. Accordingly, the left arm lever 52A and the right arm lever 52B can swing forward and backward, and the holding portion 622 can swing horizontally, in relative to the pillar structure 66.

Accordingly, the present invention provides figure trimmers featuring in that each pedal not only can rotate around the central axle, but also can rotate around its own shaft. Many muscles of the user, at least including muscles of thigh, shank, waist, and ankle will be trained by this mechanism, and hence the training efficiency can be promoted.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A figure trimmer, comprising:

a chassis comprising an upward protruded axle;

a pedal set arranged on the chassis and having a left pedal and a right pedal for being stepped on by a user;

a rotating assembly movably connecting with the chassis and the pedal set, wherein the rotating assembly comprises a hollow cylinder arranged on the axle of the chassis and two supporting frames respectively arranged at a left side and a right side of the cylinder, the two supporting frames respectively having a first shaft and a second shaft at an end far from the cylinder, and wherein the first shaft movably couples with the left pedal, and the second shaft movably couples with the right pedal;

at least a first elastic component arranged between the chassis and the rotating assembly, wherein when the rotating assembly rotates the pedal set around the axle and compresses the first elastic component, the first elastic component exerts a counterforce to the pedal set via the rotating assembly; and a plurality of second elastic components arranged below each of the left pedal and the right pedal, wherein each of the plurality of second elastic components is cylinder-shaped and is downward protruded from a bottom of the left pedal or the right pedal, wherein when the left pedal or the right pedal rotates around the first shaft or the second shaft causing a contact between the corresponding supporting frame and one or more of the plurality of second elastic components, the one or more of the plurality of second elastic components exerts a counterforce to the corresponding supporting frame;

whereby the left pedal and the right pedal horizontally rotate around the axle, the left pedal rotates around the first shaft, and/or the right pedal rotates around the second shaft.

2. The figure trimmer as set forth in claim 1, wherein the pedal set further comprises a left pad on the left pedal and a right pad on the right pedal.

3. The figure trimmer as set forth in claim 1, wherein the first elastic component and the second elastic component are made of a polymer.

4. The figure trimmer as set forth in claim 1, wherein the first elastic component and the second elastic component are two spring members.

* * * * *